US006644478B2

(12) United States Patent
Keuschnigg

(10) Patent No.: US 6,644,478 B2
(45) Date of Patent: Nov. 11, 2003

(54) SEPARATING WHEEL

(76) Inventor: Josef Keuschnigg, Lormanberg 67, Kirchberg (AT), A-8324

( * ) Notice: Subject to any disclaimer, the term of this patent is extended or adjusted under 35 U.S.C. 154(b) by 6 days.

(21) Appl. No.: 09/938,660

(22) Filed: Aug. 27, 2001

(65) Prior Publication Data

US 2002/0033357 A1 Mar. 21, 2002

(30) Foreign Application Priority Data

Aug. 28, 2000 (EP) ..... 00890260

(51) Int. Cl.[7] ..... B07B 4/00; B07B 7/00
(52) U.S. Cl. ..... 209/135; 209/139.1; 209/142
(58) Field of Search ..... 209/135, 137, 209/139.1, 142, 143, 710, 713, 714

(56) References Cited

U.S. PATENT DOCUMENTS 2,281,318 A * 4/1942 Neufeld ..... 416/215
2,453,593 A * 11/1948 Putney ..... 55/398
3,076,633 A * 2/1963 Bridle et al. ..... 416/216
4,382,804 A * 5/1983 Mellor ..... 95/270
5,957,299 A * 9/1999 Keuschnigg et al. ..... 209/135
6,224,656 B1 * 5/2001 Kawamoto ..... 96/331
6,228,151 B1 * 5/2001 Conrad et al. ..... 95/271

FOREIGN PATENT DOCUMENTS

DE 246 049 A1 5/1987
DE 197 43 491 A1 4/1998
JP 07051630 2/1995

* cited by examiner

*Primary Examiner*—Donald P. Walsh
*Assistant Examiner*—Joseph C Rodriguez
(74) *Attorney, Agent, or Firm*—Young & Thompson

(57) ABSTRACT

In a separating wheel for an air separator the radially outside ends of the separating wheel blades are tilted backwards in the direction of rotation of the separating wheel. In the area of the radially outside end of the separating wheel blades the front wall of the separating wheel blades which is viewed in the direction of rotation is tilted to the radial direction at a greater angle than the rear blade wall. Very good separating behavior is achieved by the dramatically inclined front wall of the separating wheel blades. The smaller tilt of the rear wall of the separating wheel blades with respect to the radial furthermore prevents the separated material from attaching to the rear wall of the separating wheel blades.

7 Claims, 2 Drawing Sheets

SEPARATING WHEEL

FIELD OF THE INVENTION

The invention relates to a separating wheel for an air separator with separator wheel blades with blade ends lying radially to the outside which are tilted backwards in the direction of rotation of the separating wheel.

BACKGROUND OP THE INVENTION

In practice, separating wheels with radially aligned blades are most common. For powder qualities with a maximum grain of roughly 100 microns satisfactory results are also possible with them.

When powder qualities with a maximum grain of roughly 60 microns are to be achieved, it is more advantageous to use separating wheels with blades tilted backward. Separating wheels with blades which are tilted against the direction of rotation of the separating wheel are known for example from DD 246 049 A1. The separation behavior, i.e. exact separation between the coarse and fine grain, is thus generally better, the more radically the blades are tilted. i.e. the larger the angle between the blades and the radial direction. Here the problem arises that the angle of incline is limited at roughly 35° since for greater inclines the separated material can attach to the rear wall of the separating wheel blade, since the sliding angle is too little and the separated material is no longer conveyed away by the flow and causes operating problems.

OBJECT OF THE INVENTION

Therefore the object of the invention is to make available a generic separating wheel in which separation behavior as good as possible is achieved by the blade ends titled backward and the resulting danger of deposits of separated material on the rear wall of the separating wheel blades is however avoided as much as possible. This object is achieved with a separating wheel with the features of claim 1.

SUMMARY OF THE INVENTION

With the separating wheel of the invention the two desired effects are advantageously achieved. First of all, the highly tilted front wall of the separating wheel blade yields very good separating behavior, since due to the radical incline of the front blade wall and the resulting higher centrifugal forces it is more difficult for the larger and heavier particles to enter the channel between the blades of the separating wheel. The smaller tilt of the rear wall of the separating wheel blade with respect to the radial furthermore prevents the separated material from attaching to the rear wall of the separating wheel blade. In this way very radical inclines of the blade ends become possible and they are beneficial for powder qualities with a maximum grain of less than 30 microns.

The respective angle of the front and rear wall of the separating wheel blades depends on many influencing factors, such as the rpm of the separating wheel, the type and composition of the separated material, and the desired degree of separation. But generally good separation behavior is achieved when the front blade wall is tilted at an angle greater than roughly 45° and the rear blade wall is tilted at an angle of less than roughly 45°.

Within the framework of the invention it is preferable if the front blade wall is tilted at an angle between 50° and 80°, preferably between 60° and 70° to the radial direction, and if the rear blade wall is tilted at an angle between 30° and 45°, preferably roughly 40°, to the radial direction.

At these angles, in a host of cases it will be possible to achieved very good separation behavior.

Other advantageous embodiments of the invention are the subject matter of the other dependent claims.

BRIEF DESCRIPTION OF THE DRAWINGS

Preferred embodiments of the invention are detailed below with reference to the drawings.

DETAILED DESCRIPTION OF THE INVENTION

Figure 1:
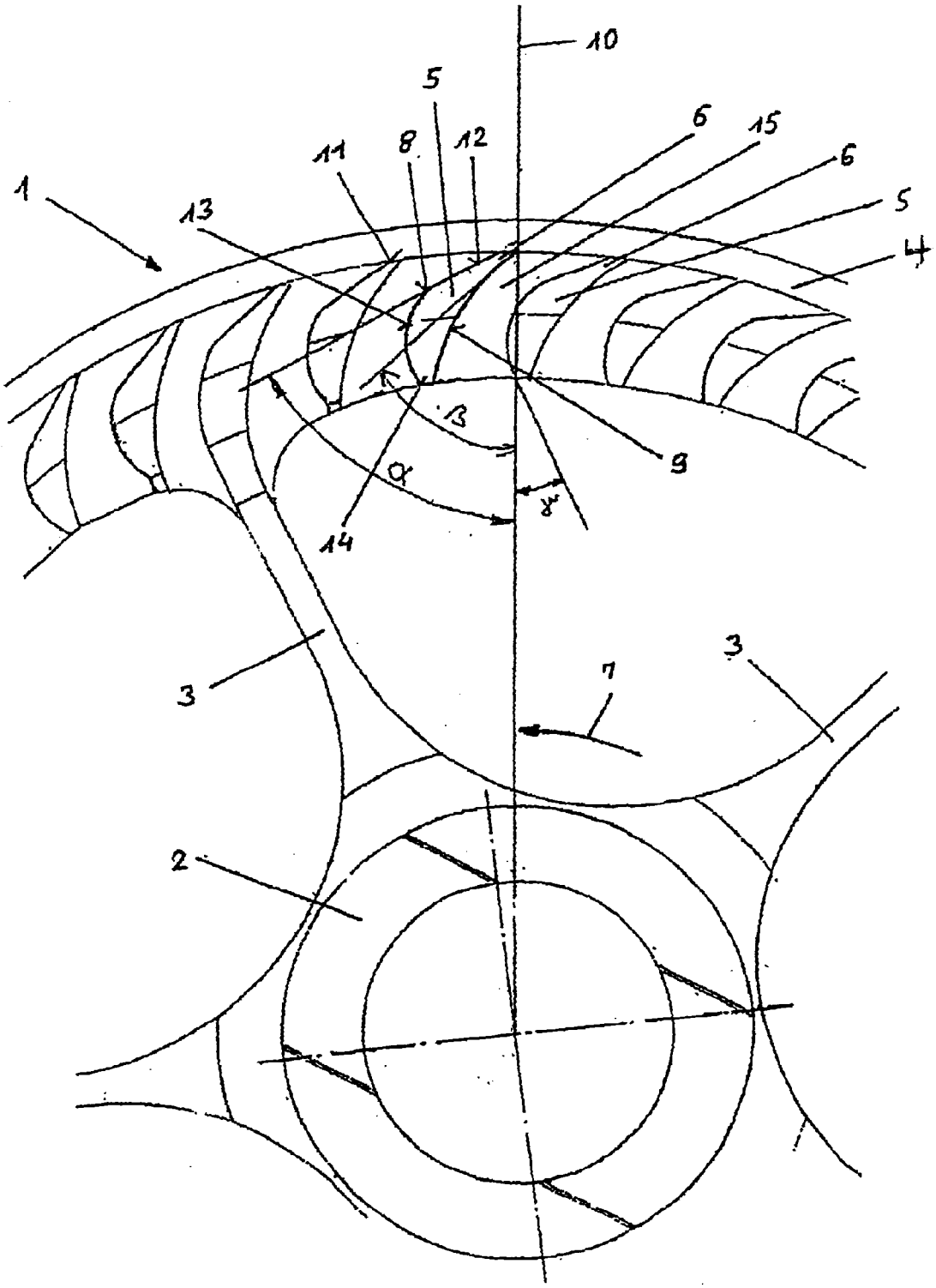
FIG. 1 shows an extract from a separating wheel with blades of a first embodiment and FIG. 2 likewise shows an extract from a separating wheel with another embodiment of the separating wheel blades.

FIG. 1 shows an extract from a separating wheel 1 as claimed in the invention, which as usual has a hub 2 and a blade wheel rim 4 which are interconnected via spokes 3. On the blade wheel rim 4 there is a plurality of separating wheel blades 5 with ends 6 lying radially to the outside which are tilted backwards against the direction of rotation of the separating wheel 1 which is labelled with the arrow 7.

The blades 5, viewed in the direction 7 of rotation, have a front blade wall 8 and a rear blade wall 9. In the area of the blade end 6 which lies radially to the outside the front blade wall 8 is tilted with respect to the radial direction 10 at an angle $\alpha$ of roughly 60°, conversely the rear blade wall 9 is tilted at an angle $\beta$ of roughly 45°. In the area of the outer blade end 6 there is furthermore the end face 11 which in the embodiment shown is tilted to the radial 10 at an angle of 90°, therefore defines the outside radius of the separating wheel in the area of its blades 5.

As can be seen in FIG. 1, the front wall 8 of the separating wheel blades 5 first has an essentially planar area 12 which passes into a curved area 13 toward the interior of the separating wheel 1. The rear wall 9 of the separating wheel blades 5 away from the outer blade end 6 is provided with an essentially continuous curvature with a radius of curvature which is greater than the radius of curvature in the area 13 on the front blade wall 8. This yields a cross sectional shape of the separating wheel blades 5 which decreases from the outer blade end 6 towards the middle area and then again towards the inner end 14. The front blade wall 8 is then tilted in the area of the inner end 14 of the blades 5 such that it is tilted at an angle $\gamma$ to the radial in the direction 7 of rotation. The angle $\gamma$ is preferably between 10° and 40°, especially preferably between 20° and 30°.

This yields a flow channel 15 between the adjacent separating wheel blades 5 which narrows first running from the outside to the inside and then widens again; this likewise benefits the separation behavior and the danger of deposits on the rear wall 9 of the separating wheel blades.

Figure 2:
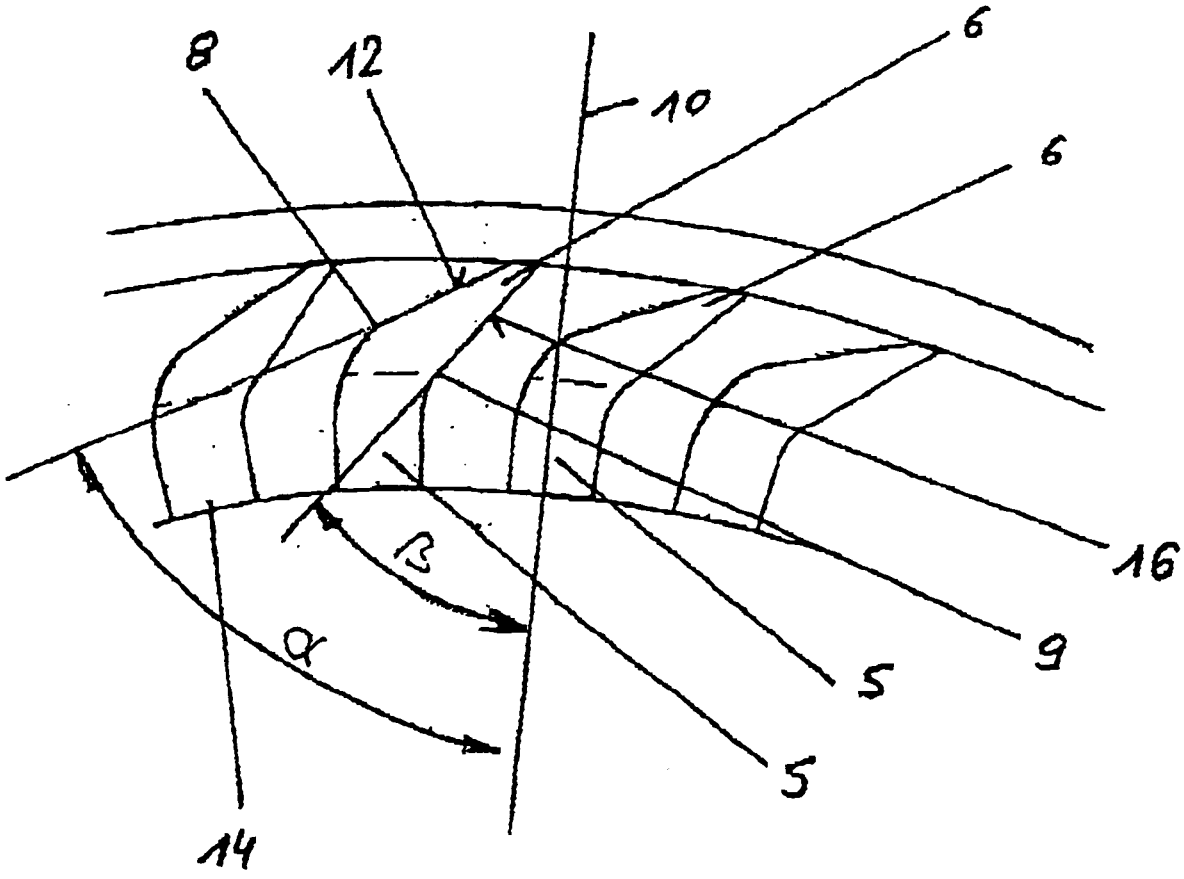

FIG. 2 schematically shows another embodiment of the separating wheel blades 5 of the invention, with the front blade wall 8 tilted in the area of the outer blade end 6 at an angle $\alpha$ of roughly 70° and with a rear blade wall 9 which is tilted at an angle $\beta$ of roughly 45° to the radial 10. The separating wheel blades 5 from FIG. 2 differ furthermore from the separating wheel blades 5 from FIG. 1 in that in FIG. 2 the rear blade wall 9 in the area of the outer blade end 6 also has an essentially planar area 16. The front blade wall 8 and the rear blade wall 9 are curved following the planar areas 12 and 16 and can be aligned roughly parallel to the radial 10 in the area of the inner end 14.

With the separating wheel of the invention, fine and extremely fine grain sizes can be separated from a flow of particle material by specific guidance of a gas flow in the area of the entry of the flow between the separating wheel blades (5) into the separating wheel. With the invention, extremely fine powder fractions can be obtained with rpm as low as possible. This is achieved essentially in that the particle-laden gas flow is exposed to a higher centrifugal force in order to travel through the channels between the separating wheel blades (5) into the inner area of the separating wheel, as this would correspond to the peripheral speed of the separating wheel. At the same time, the otherwise problematic deposition of separated material on the rear blade wall (9) is prevented by the smaller tilt of the rear blade wall (9).

What is claimed is:

1. A separating wheel for an air separator, said separating wheel turning in one direction of rotation, said separating wheel having:

wheel blades (5), said wheel blades having radially outer blade ends (6) that are tilted backward in said direction of rotation, said ends (6) having front walls (8) and rear walls (9), said front walls (8) forming a larger angle with a radius of said wheel than said rear walls (9), whereby said front and rear walls converge endwise outwardly of said wheel.

2. A separating wheel as claimed in claim 1, wherein said angle of said front wall (8) is greater than 45° and said angle of said rear wall (9) is less than 45°.

3. A separating wheel as claimed in claim 1, wherein said angle of said front wall (8) is 50° to 80°.

4. A separating wheel as claimed in claim 2, wherein said angle of said rear wall (9) is from 30° to less than 45°.

5. A separating wheel as claimed in claim 1, wherein, in a region spaced from said blade ends (6), said front walls are convex and said rear walls are concave.

6. A separating wheel as claimed in claim 1, wherein said blades (5) have a greatest thickness intermediate radially inner and outer edges of said blades.

7. A separating wheel as claimed in claim 1, wherein said front wall adjacent a radially inner portion of said front wall is tilted at an angle between 10° and 40° relative to a radius of said wheel, in a direction opposite an angle at which said front wall is tilted to said radius adjacent said blade ends (6).

* * * * *